US012709870B2

(12) United States Patent
Oskarsson et al.

(10) Patent No.: US 12,709,870 B2
(45) Date of Patent: Aug. 18, 2026

(54) HYDRAULIC ARRANGEMENT

(71) Applicant: Danfoss Power Solutions G.m.b.H & Co. OHG, Neumünster (DE)

(72) Inventors: Birkir Oskarsson, Sonderborg (DK); Thomas Heegaard Langer, Broager (DK); Erik Westergaard, Nordborg (DK)

(73) Assignee: DANFOSS POWER SOLUTIONS G.M.B.H. & CO. OHG, Neumunster (DE)

( * ) Notice: Subject to any disclaimer, the term of this patent is extended or adjusted under 35 U.S.C. 154(b) by 418 days.

(21) Appl. No.: 17/464,933

(22) Filed: Sep. 2, 2021

(65) Prior Publication Data

US 2022/0090358 A1 Mar. 24, 2022

(30) Foreign Application Priority Data

Sep. 24, 2020 (DE) ..... 102020124867.9

(51) Int. Cl.
*E02F 9/22* (2006.01)
*E02F 9/26* (2006.01)

(52) U.S. Cl.
CPC ..... *E02F 9/2246* (2013.01); *E02F 9/2207* (2013.01); *E02F 9/265* (2013.01)

(58) Field of Classification Search
CPC ..... E02F 9/2246; E02F 9/2207; E02F 9/265; E02F 9/2029; E02F 3/431; E02F 3/96
See application file for complete search history.

(56) References Cited

U.S. PATENT DOCUMENTS

| | | | | |
|---|---|---|---|---|
| 4,499,960 | A | 2/1985 | Ehrich et al. | |
| 5,784,945 | A | 7/1998 | Krone et al. | |
| 10,053,838 | B2 | 8/2018 | Kean et al. | |
| 2002/0087244 | A1 | 7/2002 | Dix et al. | |
| 2009/0045017 | A1* | 2/2009 | Joergensen | A01B 63/1013 187/345 |

(Continued)

FOREIGN PATENT DOCUMENTS

| | | | |
|---|---|---|---|
| CN | 1681731 | A | 10/2005 |
| CN | 107567517 | A | 1/2018 |

(Continued)

OTHER PUBLICATIONS

English machine translation of KR20120000857A (Year: 2012).*
Office Action corresponding to Chinese Patent Application No. 02111125616.8, dated Aug. 18, 2023, and its English translation.

*Primary Examiner* — Navid Z. Mehdizadeh
*Assistant Examiner* — Caitlin R Mccleary
(74) *Attorney, Agent, or Firm* — McCormick, Paulding & Huber PLLC

(57) ABSTRACT

The invention relates to a method (50) of operating an actuated arrangement (1) including a lifting boom (3), an associated lifting actuator (4), a tool attachment device (5) for attachment of a tool (7, 23), and an associated tilting actuator (6). The torque that is exerted onto the tool attachment device (5) is calculated using the attitude of the tool attachment device (5), a mass information, representing the mass that is connected to the tool attachment device (5), and a tool type information, representing the characteristics of the tool (7, 23) that is to be attached to the tool attachment device (5).

21 Claims, 3 Drawing Sheets

(56) References Cited

U.S. PATENT DOCUMENTS

| | | | | |
|---|---|---|---|---|
| 2009/0139119 | A1* | 6/2009 | Janardhan | G01G 19/021 37/413 |
| 2010/0161185 | A1* | 6/2010 | Marathe | E02F 3/431 701/50 |
| 2014/0032057 | A1* | 1/2014 | Li | E02F 9/2246 701/50 |
| 2015/0354177 | A1* | 12/2015 | Shatters | E02F 3/422 414/815 |
| 2016/0138249 | A1* | 5/2016 | Conway | G06T 11/00 701/50 |
| 2016/0319509 | A1* | 11/2016 | Zent | E02F 3/432 |
| 2017/0191245 | A1 | 7/2017 | Shatters et al. | |
| 2018/0230671 | A1* | 8/2018 | Wu | E02F 9/265 |
| 2018/0245306 | A1* | 8/2018 | Lewis | E02F 3/7622 |
| 2019/0145814 | A1* | 5/2019 | Hansen | B66F 9/0755 177/1 |
| 2020/0131739 | A1* | 4/2020 | Ueda | E02F 9/264 |
| 2020/0131741 | A1* | 4/2020 | Lehmann | E02F 9/264 |
| 2020/0157775 | A1* | 5/2020 | Sawodny | G01G 19/083 |
| 2021/0340724 | A1* | 11/2021 | Kenkel | F16F 15/002 |

FOREIGN PATENT DOCUMENTS

| | | | | |
|---|---|---|---|---|
| CN | 107923152 | A | | 4/2018 |
| CN | 110206092 | A | | 9/2019 |
| CN | 110316681 | A | | 10/2019 |
| DE | 102011002712 | A1 | | 7/2012 |
| DE | 102018126809 | A1 | | 4/2020 |
| KR | 2012000857 | A | * | 1/2012 |

* cited by examiner

HYDRAULIC ARRANGEMENT

CROSS-REFERENCE TO RELATED APPLICATION

This application claims foreign priority benefits under 35 U.S.C. § 119 to German Patent Application No. 102020124867.9 filed on Sep. 24, 2020, the content of which is hereby incorporated by reference in its entirety.

TECHNICAL FIELD

The invention relates to a method of operating an actuated arrangement comprising a lifting boom, an associated lifting actuator, a tool attachment device for attachment of a tool, and an associated tilting actuator. The invention further relates to an actuated arrangement comprising a lifting boom, an associated lifting actuator, a tool attachment device for attachment of a tool, and an associated tilting actuator. Even further, the invention relates to a controller device and to a working vehicle.

BACKGROUND

Actuator arrangements with an actuated lifting boom and an actuated tool attachment device are a common sight in a plethora of technical fields and technical applications. Just to name a few examples: such actuator arrangements are well known in agriculture from tractors with a lifting boom and from telehandlers, and also from warehouses and construction sites in form of wheel loaders (in particular telescopic wheel loaders) and the like.

To simplify the actuation of the actuator arrangement, and also to save energy and to decrease wear of actuating components (in case hydraulic actuators are used, not only of hydraulic pistons or hydraulic motors, but also of hydraulic pumps serving the hydraulic arrangement), a powered actuation is usually only performed if a powered actuation of the respective actuator is really needed. Contrary to this, if parts of an actuated arrangement move on their own volition (at least in case a "stopping device" is released; for example, releasing a break, opening a venting orifice or the like), usually no positive power is applied for performing the movement. Put in other words, the movement of the actuator arrangement is realised by "leaving the actuator arrangement to itself". For completeness, it should be noted that this does not exclude the possibility of slowing down the movement of the actuator arrangement that is caused by its own volition, e.g. by using mechanical brakes or by applying fluid dynamical resistance forces.

To use a predominant example: in case of a teleloader, the lifting boom and the lifting actuator (typically a hydraulic cylinder) have to work against gravity to perform an upward movement of the lifting boom. For this, pressurised hydraulic fluid has to enter the respective lifting hydraulic piston. Mechanical power has to be used to pressurise the fluid and to create a sufficient fluid flow for this lifting action. When the lifting boom has to be lowered, however, gravity alone is usually able to do the job. It is clear that therefore no mechanical power is needed to perform the respective movement, so that energy can be saved. As a side effect, mechanical wear and generated noise can be reduced as well. To effectuate the downward movement a venting valve is opened, so that pressurised fluid can leave the lifting hydraulic piston and flow back into a storage tank. To regulate the speed of the downward movement, the respective venting valve can be controlled to have an orifice of a variable size, so that a different fluid flux may flow through the orifice.

While this approach has undeniable advantages, it also shows certain disadvantages. The major disadvantage is that for a certain setting of a control organ (for example position of a control lever or position of a control joystick) the speed of the downward movement varies largely in dependence of the load on the respective part of the actuated arrangement, and thus the load on the respective actuator (for example in case of lifting boom: the lifting actuator, in particular a lifting hydraulic piston).

The standard approach for dealing with this problem is to simply tolerate this behaviour and to leave an appropriate readjustment of the control organ to the operator. One has to admit that this is normally not a major problem for a well skilled operator. However, for a novice the described change of movement speed with the load can be a challenge. Even worse, if the actuated arrangement holds an unexpectedly high load, the downward movement of the arrangement will be accordingly high initially, when the operator chooses his "standard input" as a first setting. This is not only a nuisance to the operator, but this can also pose a danger and lead to a wear or damage of the loads and/or of the actuated arrangement if the load either touches ground or the operator stops his movement abruptly because he is surprised by the fast movement. This can easily happen even to a well skilled operator.

This problem was already identified in the prior art for the lifting boom. Here, a system was already suggested, where the current load on the lifting boom was measured using an appropriate sensor (for example a force transducer or a pressure transducer measuring the pressure in the hydraulic fluid, particularly in case a hydraulic piston is used as an actuator). Based on this sensor signal a certain setting of a control organ by an operator was modified so as to generate and apply a control signal to the control valve in a way that a certain position of the control organ leads to essentially the same downward movement speed, (largely) independently from the actual load on the lifting boom.

A problem occurs, however, when an actuator arrangement is used that comprises more than one movable part, for example an actuator arrangement that has a plurality of movable parts, where the movable parts are connected one to each other in series (which is the standard design). Applying the afore described idea to such an actuated arrangement with a plurality of movable parts would mean that an appropriately large number of sensors had to be used. This would increase the cost and also the likelihood of a technical failure of a sensor (causing repair cost and maintenance shutdowns). Therefore, there is a certain aversion in the state of the art to use the afore described control method for an actuated arrangement with a larger number of actuated parts.

SUMMARY

It is therefore an object of the present invention to suggest a method of operating an actuated arrangement comprising a lifting boom, an associated lifting actuator, a tool attachment device for attachment of a tool, and an associated tilting actuator that is improved over previously known methods of actuating an actuated arrangement. The invention further relates to an improved controller device, an improved actuated arrangement, and an improved working vehicle.

It is suggested to employ a method of operating an actuated arrangement comprising a lifting boom, an associated lifting actuator, a tool attachment device for attachment of a tool, and an associated tilting actuator in a way that the torque that is exerted onto the tool attachment device is calculated using the attitude of the tool attachment device, a mass information, representing the mass that is connected to the tool attachment device, and a tool type information, representing the characteristics of the tool that is attached to the tool attachment device. Using this proposal, it is possible to—at least largely—decouple the connection between the amount and/or distribution of the mass of the tool (including goods) connected to the tool attachment device and the speed of a passive movement (in particular a gravity assisted movement; downward movement; a forward rotational movement; a dumping movement; a goods releasing movement) of the tool attached to the tool attachment device. This is done by calculating the torque that is exerted onto the tool attachment device. It is to be understood that it is usually sufficient that the calculation yields a more or less good approximation of the torque. In particular, thinking about the afore described surprising effect that an unexpectedly large mass that is held by the tool, which in turn is connected to the tool attachment device, causes an unexpectedly fast passive movement of the tool attachment device when the operator applies a certain setting of the control organ, this unexpected behaviour can usually already be sufficiently reduced if a reasonable estimation of the torque is obtained. In detail: an extremely good estimation with only a few percent of uncertainty of the torque might be interesting from an academic viewpoint; however, since a standard operator will usually apply a somewhat estimative and conservative control command, in particular if the tool is close to an obstacle and/or if the goods that are held by the tool look somewhat heavy (albeit less heavy than they are), a reasonable operator will command a relatively slow movement initially. Even if the actual moving speed would exceed the desired moving speed by—say—up to 10%, 20%, 30%, 40% or even 50% (just to give some examples), the resulting moving speed would still be sufficiently slow to not unduly surprise the operator. Further, a major input in form of a mass information can come from a source (typically a sensor) that is already present, or so to say that is "present anyhow" for a usual set-up of an actuated arrangement. Indeed, nowadays designs quite often measure (at least approximately) the load on the actuated arrangement. This is done for a variety of purposes, for example for compensating a passive downward movement of the lifting boom (in an effort to at least approximately decouple the passive movement speed from the load on the lifting boom), or for being able to supply sufficient power, when an upward movement of the lifting boom is commanded. Typically, the measurements are taken using a force transducer/force measuring sensor that is mounted on and/or in mechanical connection with a lifting boom, a pressure sensor (pressure transducer) for measuring the hydraulic pressure of the lifting actuator or by using any other suitable sensor or device (including its placement). Using a different wording, the mass information that is gained already is used for an additional purpose. In any case, using the present proposal, an additional sensor for purposes of compensating the actuation command of the tool attachment device can be avoided, or at least the respective sensor can be less precise or less reliable, since a certain additional redundancy is provided. Furthermore, a tool type information is used for calculating the torque that is exerted onto the tool attachment device. This is because different tools will show a different connection between the loaded mass and the torque exerted, where the dependency can be an "absolute" multiplicative factor and/or a dependency between the tilt angle and the torque and/or a different dependency. As an example, a bale grappler will usually have a larger distance between the centre of gravity and the rotational axis of the tool attachment device, as compared to a shovel or bucket (which manifests itself essentially in a different multiplicative factor). Additionally or alternatively, the functional connection between the current angle/attitude of the tool attachment device (with respect to the horizon/ambient surroundings and/or the lifting boom and/or a different device) and the torque acting on the tool attachment device is usually different for different tools that are attached to the tool attachment device as well. How the tool type information is obtained is essentially irrelevant. In particular, a manual or an automated input (or a combination thereof) may be used, where for reasons of user-friendliness an automated input is typically preferred. The lifting actuator and/or the tilting actuator can be of an essentially arbitrary design. However, they should show a possibility for a passive movement. In particular, a gravity assisted movement of the respective actuator(s) should be possible. This particularly applies to the tilting actuator(s). A predominant example for such an actuator/such actuators is a hydraulic piston. For completeness, it should be noted that in case of a hydraulic piston (not excluding certain other types of actuators) a torque on the tool attachment device typically translates into a translational force/linear force onto the hydraulic piston (of a different actuator). It is to be noted that this does not necessarily imply a linear relationship between torque and cylinder force. On the contrary, usually there will be a non-linear relationship (in particular since there is typically some sort of a linkage present).

In particular, the method should be employed in a way that the characteristics of the tool that is (to be) attached to the tool attachment device include the length of the distance between the point of rotation and the centre of gravity of the tool that is (to be) attached to the tool attachment device and/or the angle enclosed between the direction of the connection between the point of rotation at the centre of gravity of the tool that is (to be) attached to the tool attachment device and the direction of gravity in dependence of the attitude and/or its mass. Using such information, typically the major influencing parameters for the torque are considered. Consequently, typically the torque that is calculated is sufficiently precise for typical fields of application. Certainly, by using more information and measurements, a more precise torque can be calculated.

In particular, it is proposed that the method is used for calculating a compensation signal for modifying the actuation signal that is applied to the tilting actuator, in particular for compensating the variation of the torque that is exerted onto the tool attachment device in dependence of the attitude of the tool attachment device, preferably in a way to maintain a constant rotational speed of the tool attachment device and/or for compensating the variation of the torque that is exerted onto the tool attachment device in dependence of the current mass of the tool (particularly including loaded goods) that is connected to the tool attachment device. Using this idea the user-friendliness of the actuated arrangement can be increased. Furthermore a risk of damage or accidents can be further reduced. In particular, the operator can set the operating command to a certain position without considering the current load on the actuated arrangement. Even if the torque at the tool attachment device is particularly large (for example due to an unexpectedly large load and/or an unexpectedly large influence of the current position/attitude of the tool attachment device/tool that is attached to the tool attachment device), the movement speed does not become too large, or is even approximately the same irrespective of the current load and/or position and/or attitude. Excessive or dangerous speeds can be thus be avoided. Furthermore, the operator is not necessarily obliged anymore to start a movement with a particularly cautious/conservative setting. Furthermore, it might be even possible that the tilting speed/rotational speed of the tool attachment device/tool that is attached to the tool attachment device remains somewhat or even essentially constant with an essentially identical setting, although the torque varies (potentially significantly) with the current attitude of the tool attachment device. This is of course a big increase in user-friendliness of the arrangement.

The compensation can be applied in a way that a full compensation occurs, which may mean that the system behaves as if there is no dependence of the speed of movement at a certain command setting, even with varying loads and/or varying positions of the tool attachment device and/or different tools attached to the tool attachment device. However, it might be also possible to employ an only partial compensation, so that an operator who is accustomed to previous machinery does not get surprised by the different operational behaviour of the arrangement. The compensation factor may be 10%, 20%, 30%, 40%, 50%, 60%, 70%, 80% or 90% (the respective values may be used as an upper and/or lower limit of a continuous interval of factors). The settings may be chosen at the factory, by the owner of the machinery ("company setting"), or even individually by the operator. This way, a "fade out" for operators who are accustomed to prior art machinery can be realised.

It is possible that the method is employed in a way that the attitude of the tool attachment device is determined using a positional information of the lifting boom and/or of the tool attachment device, in particular using the information of at least one position sensor and/or of at least one translational position sensor and/or of at least one angular position sensor. This way, a reliable value for the attitude can be determined, employing comparatively cheap sensors. Furthermore, it should be noted that such sensors are quite often already employed in the context of actuated arrangements of the present type for different purposes, for example for limiting the movement range or for providing a measured end stop for an actuator, as an example). It is to be noted that a positional information with respect to the tool attachment device alone is usually not sufficient, since the attitude of the tool attachment device is usually also influenced by (at least) the position of the lifting boom and/or other components. Therefore, a plurality of information is usually necessary for determining a sufficiently precise attitude information.

Furthermore, it is proposed to employ the method in a way that the mass that is connected to the tool attachment device is determined using a load information representing a load acting onto the lifting boom, in particular using an information from a pressure sensor, preferably a pressure sensor representing the load acting on the lifting actuator. This way, a mass information may be obtained. The pressure measurement may be taken (i.e. the respective pressure sensor may be placed) inside of the respective chamber, but also in the vicinity thereof, for example in a hydraulic line serving the respective chamber (where the distance between the chamber and the point of measurement should be comparatively short, so as to avoid any measurement errors from fluid losses or the like). Frequently, such information/such sensors are already determined and/or employed with present day actuated arrangements of the present type. Therefore, the requirement for additional sensors can be avoided. Also, it is possible to use less precise and/or less reliable additional sensors, since a certain level of redundancy is present, thanks to the suggested design.

Preferably, the method is performed in a way that sensor information, in particular pressure sensor information, is compensated for friction, speed and fluid flow effects, influencing the information obtained by the sensors. This way, the preciseness of the calculated torque can be further increased. In particular, in many cases this can be done using sensor values that are already determined for a different purpose. Therefore, this modification can be realised without additional sensors and at little cost.

Preferably, the lifting actuator and/or of the tilting actuator comprises at least a hydraulic actuator, in particular at least a hydraulic piston, or is essentially designed as a hydraulic actuator, in particular as at least a hydraulic piston. This way, the mechanical design of the actuated arrangement resembles standard designs, so that the method can be employed with only minor adjustments of the actuated arrangement, or even as a drop-in solution for present-day actuated arrangements. This way, the method can be employed particularly cheap, and/or the acceptance for employing the presently proposed method can be increased.

Furthermore, it is suggested that the tool type information is determined using an automated tool type identification device and/or using tool type information that is entered by an operator and/or using tool type information that comes from a movement characteristics obtained during operation of the actuated arrangement. An automated tool type identification device can come from a mechanical device, for example a certain mechanical coding that is applied to a tool and that is read in by an appropriately designed mechanical code reader (for example using sensor pins or the like). Additionally or alternatively, an optical reader can be used that reads an optical marking that may be placed on a tool. Further additionally or alternatively, a wireless identification, in particular using an RFID device and an appropriate reader may be employed. Using such an automated tool type identification device is particularly user friendly and usually quite failsafe as well. Nevertheless, additionally or alternatively, a manual entry by an operator may be advantageous as well, for example as a fallback solution if an automated reading fails. Furthermore, a manual entry may be employed when the actuated arrangement is used as of a drop-in solution for standard equipment or the like. In particular, it should be noted that even if an appropriately designed actuated arrangement with an appropriate reader for reading in a tool type information is used, the actuated arrangement should still be operative with already present tools. This way, the presently proposed actuated arrangement can be easily used as a replacement for a defective one, and nevertheless already present tools can be continued to be used. Additionally or alternatively, if movement characteristics that are gained during operation of the actuator arrangement are used, an automated tool type identification may be possible, even without an automated tool type identification device/a tool comprising a tool type information, at least after a certain time of operation. Furthermore, this may be used for refining the compensation quality of the presently proposed method, and/or for recognising reading errors by the automated tool type identification device and/or for detecting faulty entries by an operator.

It is further proposed that the calculation is performed using a mathematical description of the arrangement and/or that a lookup table is used for performing the calculation. A mathematical description may yield a particularly good compensation effect. Using a lookup table for performing the calculation may be advantageous in that fewer calculations are necessary and the method may be employed in connection with already present controllers (since the additional computations can be performed on the already present electronic controller), as an example. It is to be noted that intermediary values may be obtained by interpolating values that are stored in the lookup table.

Furthermore, it is proposed to employ the method in a way that the actuated arrangement comprises a tool that is attached to the tool attachment device, where the tool is preferably taken from the group comprising forks, bale grapplers, shovels and buckets. The tools (in particular the expressly named tools, but also other ones) are preferably used interchangeably. First experiments have shown that in this case the method yields particularly good results.

Furthermore, a controller device, in particular an electronic controller device is proposed that is designed and arranged to perform a method according to the previous description. The controller device may be designed and/or modified in the previously described sense as well, at least in analogy. This way, the controller device may show the same advantages and characteristics as the previously described method, at least in analogy.

Furthermore, an actuated arrangement, comprising a lifting boom, an associated lifting actuator, a tool attachment device for attachment of a tool, an associated tilting actuator and a controller device of the previously described type is suggested. The actuated arrangement may be designed and/or modified in the previously described sense as well, at least in analogy. Such an actuated arrangement may show the same characteristics and advantages as previously described, at least in analogy.

Further, a working vehicle is proposed that comprises an actuated arrangement of the aforementioned type. The working vehicle may be designed and/or modified in the previously described sense, at least in analogy. Such a working vehicle may show the same characteristics and advantages as previously described as well, at least in analogy.

BRIEF DESCRIPTION OF THE DRAWINGS

Further advantages, advantages, features, and objects of the invention will be apparent from the following detailed description of the invention in conjunction with the associated drawings, wherein the drawings show.

DETAILED DESCRIPTION

Figure 1:
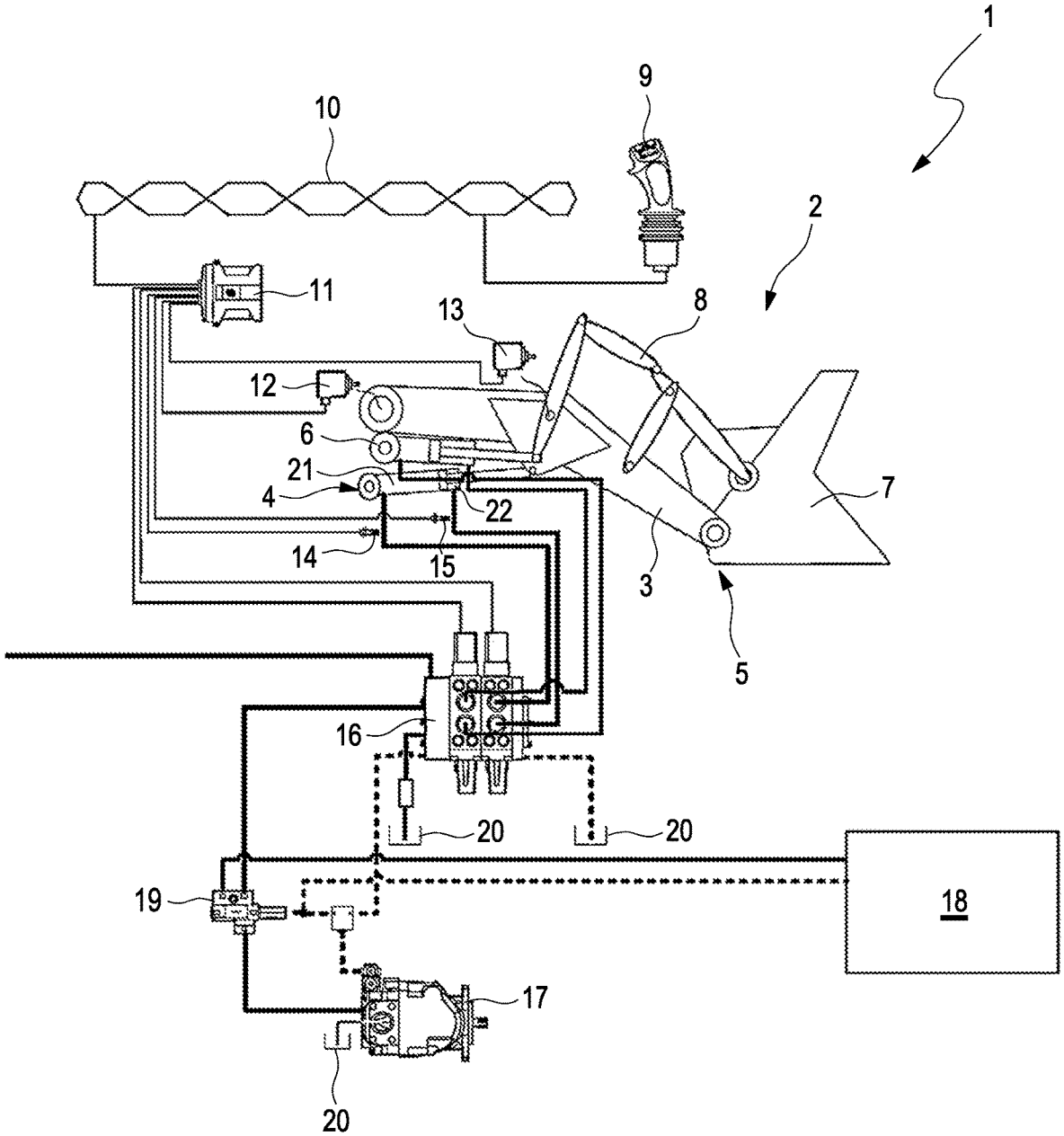
FIG. 1: a schematic of an embodiment of an actuated hydraulic arrangement.

FIG. 1 shows a schematic arrangement of a possible embodiment of an actuated hydraulic arrangement 1. The actuated hydraulic arrangement 1 comprises a hydraulically actuated boom arrangement 2, comprising a lifting boom 3 and a tool attachment device 5 with a tool attached to it. Presently, the tool attached to the tool attachment device 5 is a shovel 7. The lifting boom 3 is actuated by a lifting hydraulic piston 4, while the tool attachment device 5 is actuated by a tilting hydraulic piston 6. The tilting hydraulic piston 6 actuates the tool attachment device 5/the shovel 7 via a Z-kinematics 8, which is known in the state of the art as such.

The movement of the hydraulically actuated boom arrangement 2 is initiated by an appropriate control input, presently made by an operator operating a control joystick 9. The control commands that are input by means of the control joystick 9 are transmitted via a vehicle bus system 10 (or by other means) to an electronic controller 11. The electronic controller 11 uses this input, together with the additional input from several sensors 12, 13, 14 and 15 (as will be discussed in detail later on) to generate output signals to a control valve arrangement 16 comprising a plurality of actuated control valves. The pressurised hydraulic oil that is needed for operation of the actuated hydraulic arrangement 1 is generated by a hydraulic pump 17.

For completeness, it should be mentioned that the hydraulic pump 17 usually supplies several additional hydraulic consumers as well. As an example for a possible hydraulic consumer, in FIG. 1 a hydraulic steering system 18 is schematically shown, where the hydraulic steering system 18 is connected to the hydraulic circuitry by means of a priority valve 19. As mentioned, this is simply shown as an example of a possible additional consumer 18, 19, were the additional consumer(s) might be optional as well (i.e. no additional consumer may be present).

Apart from the control input by the control joystick 9, in the presently shown embodiment the electronic controller 11 also receives an input from a boom angle sensor 12, a tool angle sensor 13, a first boom piston pressure sensor 14, and a second boom piston pressure sensor 15.

The boom angle sensor 12 measures the angle of the lifting boom 3 with respect to the vehicle chassis (not shown), the hydraulically actuated boom arrangement 2 is connected to. Similarly, the tool angle sensor 13 measures the angle of the tool attachment device 5 with respect to the lifting boom 3. As it is clear for a person skilled in the art, the attitude of the tool attachment device 5 (and therefore the attitude of the tool itself; presently a shovel 7) with respect to the surroundings/horizon/vehicle chassis can be determined by appropriately combining the measurement valves of boom angle sensor 12 and tool angle sensor 13. The necessary calculations may be performed by the electronic controller 11.

Further, first boom piston pressure sensor 14 (essentially) measures the hydraulic fluid pressure in the first piston chamber 21 of the lifting hydraulic piston 4 (the first piston chamber 21 increases in volume, when the lifting boom 3 is raised; consequently, during such a movement fluid flows into the first piston chamber 21 and out of the second piston chamber 22; further, during such a movement, the pressure in the second piston chamber 22 is lower than the pressure in the first piston chamber 21), while the second boom piston pressure sensor 15 (essentially) measures the hydraulic fluid pressure in the second piston chamber 22 of lifting hydraulic piston 4 (the second piston chamber 22 increases in volume, when the lifting boom 3 is lowered; consequently, during such a movement fluid flows into the second piston chamber 22 and out of the first piston chamber 21; further, during such a movement, the pressure in the second piston chamber 22 may be lower or higher than the pressure in the first piston chamber 21, depending whether a passive (gravity assisted) movement, or a positively powered movement occurs, respectively). Indeed, this may be the reason why two pressure sensors 14, 15 are employed. If a positively powered down movement situation (almost) never occurs, use of a single pressure sensor 14, 15 may prove to be sufficient (namely first boom piston pressure sensor 14).

The use of the presently shown and described sensors 12, 13, 14, 15 (i.e. boom angle sensor 12, tool angle sensor 13, first 14 and second 15 boom piston pressure sensor) is quite widespread for actuated boom arrangements of the type, presently in question.

It is further customary in the prior art that for a lowering movement of the lifting boom 3 and/or a dumping movement of a shovel 7 (equivalent to a clockwise movement in FIG. 1) gravity is used. This is done for saving energy, and also to reduce the generation of noise and to reduce wear of the various components of the actuated hydraulic arrangement 1. Therefore, a lowering movement of the lifting boom 3 is normally commanded by the electronic controller 11 (on receiving an appropriate control command from the operator via control joystick 9) by actuating the various control valves of the control valve arrangement 16 in a way that an orifice is opened so that first piston chamber 21 of lifting hydraulic piston 4 (whose pressure is measured by first boom piston pressure sensor 14) becomes fluidly connected to the fluid reservoir 20, so that hydraulic fluid can leave the respective chamber 21 towards a fluid reservoir 20. At the same time, another orifice is opened so that the second piston chamber 22 of lifting hydraulic piston 4 (whose pressure level is measured by a second boom piston pressure sensor 15) is connected to the fluid reservoir 20 as well, so that fluid from the fluid reservoir 20 can fill the increasing volume of second chamber 22 of the lifting hydraulic piston 4. The speed of the lowering movement is controlled by an appropriately chosen size of the orifices. How the variable size orifice is technically implemented is usually not of a major relevance. In particular, solutions that are known in the art may be employed. As an example, displacing of a spool (that is an actuated one) may be used for this. Preferably, there should be some kind of a continuity between the operator input and the size of the orifice. Mathematically speaking, the connection should be monotonically increasing, preferably strictly monotonically increasing.

Since the fluid flow though the respective valves of the control valve arrangement 16, which determines the linear moving speed of the lifting hydraulic piston 4, not only depends on the size of the orifices of the control valves, but also depends on the pressure differential over the respective valves, the load on the lifting boom 3 has an influence on the lowering speed as well. This is, because the load on the lifting boom 3 influences the pressure differential $\Delta p$ over the valves. In detail, the formula $Q=k A\sqrt{\Delta p}$ holds, where Q is the flow through the valve, k is the valve constant, A is the opening area of the valve, and $\Delta p$ is the pressure differential across the valve.

The load on the lifting boom 3, however, can be determined from the pressures measured by first 14 and second 15 boom piston pressure sensor (at least approximately). The input from these sensors 14, 15 is therefore used by the electronic controller 11 to modify the control signal inputted by control joystick 9 in a way that the lowering speed approximately only depends on the angle of the control joystick 9, and not any more on the load on the lifting boom 3.

A further modification of the presently described actuated hydraulic arrangement 1 over a standard actuated hydraulic arrangement lies in the fact that the electronic controller 11 further uses the various sensor inputs by sensors 12, 13, 14, 15 (i.e. boom angle sensor 12, tool angle sensor 13, first boom piston pressure sensor 14 and second boom piston pressure sensor 15) to calculate the torque on the tool attachment device 5 more precisely (at least approximately). It is to be noted that the torque acting on the tool attachment device 5 depends on the position of both lifting boom 3 and tool attachment device 5, the load that is currently held by the tool (and therefore approximately the load acting on the lifting boom 3, when the weight of the tool is added; however, the force is usually dependent on the position of the lifting boom 3 and of the tool attachment device 5 as well), and the type of tool that is attached to the tool attachment device 5, which will be described in more detail in the following.

Similar to the modification of the control signal for the control valve arrangement 16 by the electronic controller 11 with respect to a valve actuation for controlling the position of lifting hydraulic piston 4 (and therefore of the lifting boom 3), the input command by the control joystick 9 is modified by the electronic controller 11 as well, before it is applied to the control valve arrangement 16, when a gravity assisted movement of the tool attachment device 5 is commanded (in the presently shown embodiment of a shovel 7; this is equivalent to a clockwise rotation of the shovel 7, as shown in FIG. 1). Also similar to the lifting boom 3, a normally gravity assisted movement of the shovel 7 (clockwise rotation) might necessitate a powered movement, depending on the current situation.

In detail, using the input by the control joystick 9 and taking into account the input data from the various sensors 12, 13, 14, 15, a modified control signal is calculated and applied to the control valve arrangement 16, so that the rotation speed of the tool attachment device 5 (and therefore of the attached tool; presently a shovel 7) essentially only depends on the position of the control joystick 9, and not any more on the load contained in the shovel 7, the position of the hydraulically actuated boom arrangement 2, and/or the type of tool attached to the tool attachment device 5.

The control schematics 30 for this actuation is shown and described in more detail with reference to FIG. 3 in the following.

Figure 2A:
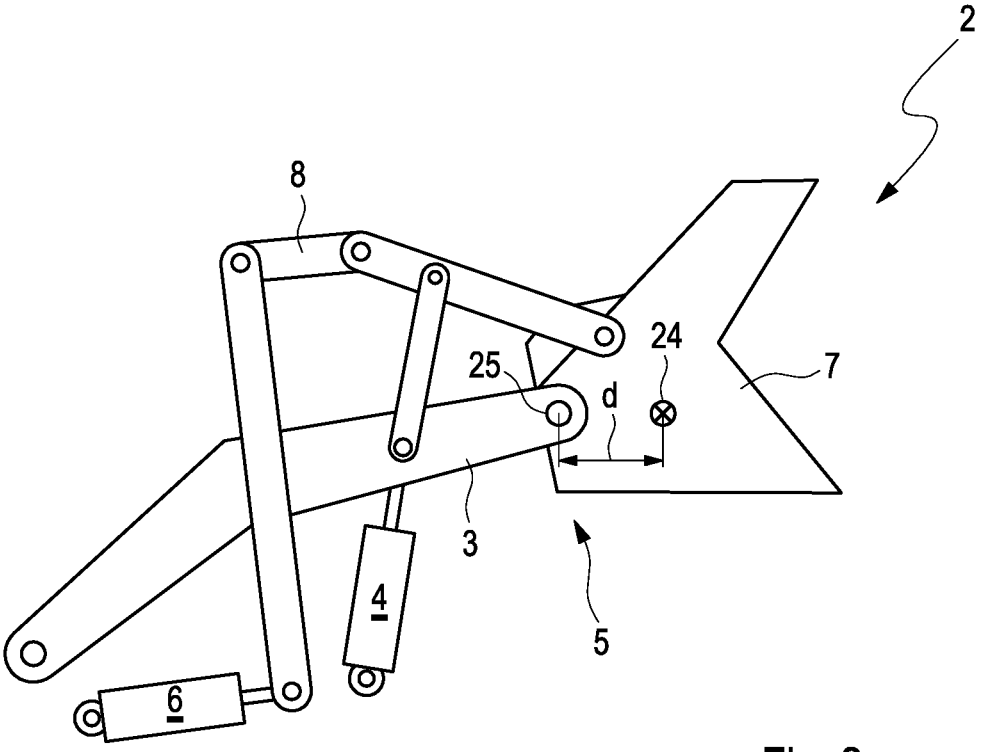
FIG. 2*a*: the mechanical section of an embodiment of an actuated hydraulic arrangement in a schematic side view with a shovel attached thereto.
Figure 2B:
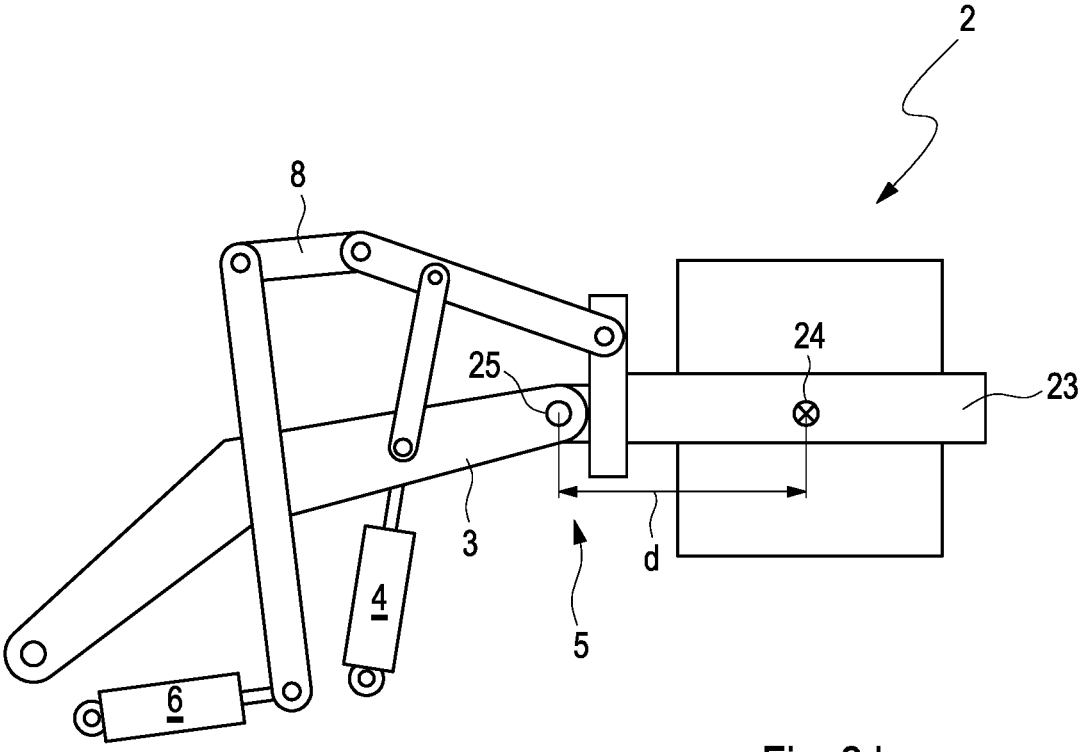
FIG. 2*b*: the mechanical section of an embodiment of an actuated hydraulic arrangement in a schematic side view with a bale grappler attached thereto.

In accordance with FIG. 2, it is shown that the type of tool 7, 23 attached to the tool attachment device 5 has a significant influence on the torque acting on the tool attachment device 5 and consequently on the force, acting on the tilting hydraulic piston 6. In detail, FIG. 2*a* shows a shovel 7 being attached to the tool attachment device 5, while in FIG. 2*b* a bale grappler 23 is attached to the tool attachment device 5. As can be seen from FIG. 2, when comparing the two sub-FIGS. 2*a*, 2*b*, the distance d between the point of rotation 25 (between tool attachment device 5 and lifting boom 3) and the centre of gravity 24 is different for a shovel 7, as opposed to a bale grappler 23. Indeed, typically the distance d between the point of rotation 25 and the centre of gravity 24 is comparatively short for a shovel 7 (where d is typically in the order of 25 cm), while it is significantly larger in the case of a bale grappler 23 (where d is typically in the order of approximately 1 m).

Figure 3:
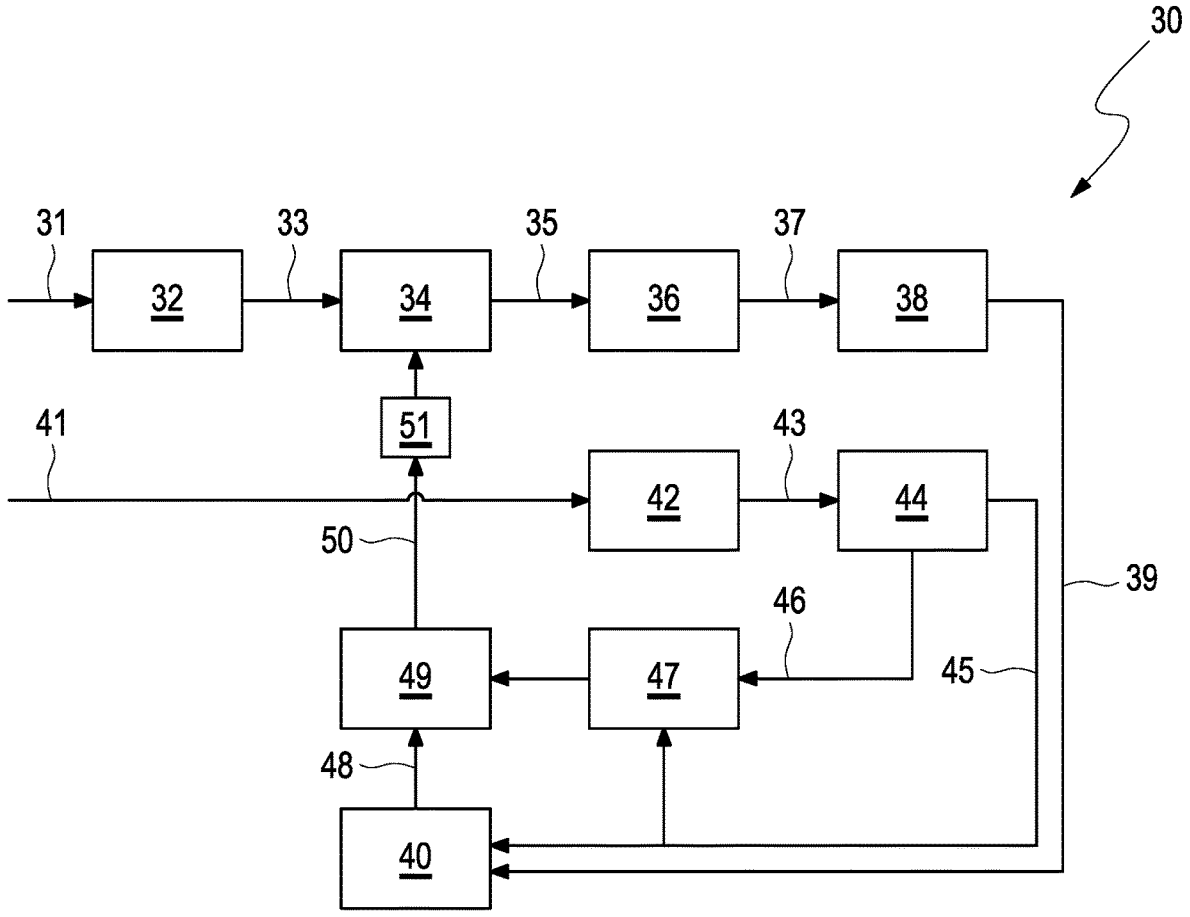
FIG. 3: a block diagram of a possible embodiment of a control scheme of a compensated actuated hydraulic arrangement.

FIG. 3 shows a block diagram 30 of the logical setup, how an operator input command (comprising a tilting aspect $CMD_{tilt}$ 31, as well as a boom moving aspect $CMD_{boom}$ 41) is modified before it is applied to the appropriate control valves of the control valve arrangement 16. The necessary calculations can be performed by an electronic controller 11, or a similar device.

The operator input command $CMD_{tilt}$ 31 (tilting aspect thereof) is first recalculated into a flow request $Q_{CMD}$ 33 (for example litres per minute) in a flow command calculation block 32. This flow request $Q_{CMD}$ is modified using the scaled flow command calculation block 34, thus generating a modified flow request $Q'_{CMD}$ 35. For performing this calculation, the scaled flow command calculation block 34 uses the (low-pass filtered) calculated pressure $p_{tilt}$ 50 in the tilting cylinder 6, the calculation thereof being described in the following. This modified flow request $Q'_{CMD}$ 35 is then translated into a valve actuation signal $Q_{act}$ 37 in a valve command block 36, and consequently applied to the respective valves of the control valve arrangement 16.

The resulting change of the attitude of the tool attachment device 5 of the attached tool 7, 23 is measured in attitude measurement block 38, using the sensor input by tool angle sensor 13 (possibly boom angle sensor 12) as well.

The attitude value $X_{tilt}$ 39 is fed into a forward kinematics block 40 as a first input signal.

In a second control thread, an operator input command $CMD_{boom}$ 41 concerning a lifting action of the lifting boom 3 is directly fed into a valve command block 42. The thus generated valve control signal $Q_{act}$ 43 is applied to the respective valves of the control valve arrangement 16. The resulting change of the position of the lifting boom 3 is measured 44 (for example using a boom angle sensor 12). The respective positional signal $X_{boom}$ 45 is fed into the forward kinematics 40 as a second input value.

It is to be noted that in the presently shown example, the commanding signal $CMD_{boom}$ 41 for the lifting boom 3 is not compensated before being applied to the lifting hydraulic piston 4. While this is certainly possible, presently it is mainly done for simplifying the explanation. Certainly, the commanding signal $CMD_{boom}$ 41 for the lifting boom 3 can be compensated similarly to the commanding signal $CMD_{tilt}$ 31 for the tilting actuator 6, like it is described above.

In parallel, the positional information of the lifting boom $X_{boom}$ 45, and preferably also the pressure information $p_{boom}$ 46, concerning lifting hydraulic piston 4 (and possibly measured by first 14 and second 15 piston pressure sensor) are fed into a speed and friction compensation block 47. Here, the contribution in pressure differences occurring from friction and/or speed/flow of the hydraulic oil is compensated for with input from the measured cylinder speed. The measured cylinder speed may be simply based on the derivative $dX_{boom}/dt$. However, some more complicated mathematical connection is possible as well. As an example, the non-linearity between the position/positional angle of the lifting boom 3 and the linear/translational speed of the hydraulic piston 4 may be considered in this context. It is to be noted that this speed and friction compensation block 47 is optional; but it improves the accuracy of the compensation.

The forward kinematics 40 uses the positional information $X_{tilt}$, $X_{boom}$ 39, 45 from the various sensors, calculates the positions $q_{act}$ 48 of the different bodies/elements of the hydraulic actuated boom arrangement 2 and forwards the respective data to a tilting hydraulic piston pressure calculation block 49. There, the estimated tilt cylinder pressure $p_{tilt}$ 50 is calculated. This is sort of equivalent to the torque that acts on the point of rotation 25 of the tool attachment device 5. The thus calculated estimated tilt cylinder pressure $p_{tilt}$ 50 is passed through a low pass filter 51 (to avoid undesired oscillations in the command signals) and is then fed to the scaled flow calculation block 34, where it is used as an additional input (as a reminder: the main input is the commanded flow $Q_{CMD}$ 33) for compensating the commanded fluid flow $Q'_{CMD}$ 35 to the respective actuated valves of the control valve arrangement 16.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A method of operating an actuated arrangement comprising a lifting boom, an associated lifting actuator, a tool attachment device for attachment of a tool, and an associated tilting actuator, wherein the method comprises determining a tool type information corresponding to a tool selected from a plurality of tools using an automated tool type identification device and/or tool type information that is entered by an operator, calculating a torque that is exerted onto the tool attachment device using an attitude of the tool attachment device, a mass information, representing a mass that is connected to the tool attachment device, and the tool type information, representing characteristics of the tool that is attached to the tool attachment device, wherein the attitude of the tool attachment device is determined using a positional information of the lifting boom and/or of the tool attachment device using information of at least one position sensor, and applying a modified control signal to a control valve arrangement to control the actuated arrangement, the modified control signal being a control signal modified based on the calculated torque, wherein the modified control signal causes a first tool of the plurality of tools to, when attached to the tool attachment device, move at an operating speed for a certain operating command position set by the operator and the modified control signal causes a second tool of the plurality of tools to, when attached to the tool attachment device, move at the operating speed at the certain operating command position.

2. The method according to claim 1, wherein the characteristics of the tool include a length of a distance between a point of rotation and a centre of gravity of the tool that is attached to the tool attachment device and/or an angle enclosed between a direction of a connection between the point of rotation and the centre of gravity of the tool that is attached to the tool attachment device and the direction of the gravity in dependence of the attitude and/or its mass.

3. The method according to claim 2, wherein the method calculates a compensation signal for generating the modified control signal, the modified control signal being such that the control valve arrangement controls the tilting actuator to compensate for a variation of the torque that is exerted onto the tool attachment device in dependence of the attitude of the tool attachment device.

4. The method according to claim 3, wherein the method calculates the compensation signal for generating the modified control signal, the modified control signal being such that the control valve arrangement maintains a constant rotational speed of the tool attachment device and/or compensates for the variation of the torque that is exerted onto the tool attachment device in dependence of the current mass of the tool that is connected to the tool attachment device.

5. The method according to claim 2, wherein the mass that is connected to the tool attachment device is determined using a load information representing a load acting onto the lifting boom using pressure information from a pressure sensor.

6. The method according to claim 1, wherein the method calculates a compensation signal for generating the modified control signal, the modified control signal being such that the control valve arrangement controls the tilting actuator to compensate for a variation of the torque that is exerted onto the tool attachment device in dependence of the attitude of the tool attachment device.

7. The method according to claim 6, wherein the mass that is connected to the tool attachment device is determined using a load information representing a load acting onto the lifting boom using pressure information from a pressure sensor.

8. The method according to claim 6, wherein the method calculates the compensation signal for generating the modified control signal, the modified control signal being such that the control valve arrangement maintains a constant rotational speed of the tool attachment device and/or compensates for the variation of the torque that is exerted onto the tool attachment device in dependence of the current mass of the tool that is connected to the tool attachment device.

9. The method according to claim 1, wherein the mass that is connected to the tool attachment device is determined using a load information representing a load acting onto the lifting boom using information from a pressure sensor.

10. The method according to claim 9, wherein the sensor information is compensated for friction, speed and fluid flow effects, influencing the information obtained by the pressure sensor.

11. The method according to claim 1, wherein the lifting actuator and/or the tilting actuator comprises at least a hydraulic actuator.

12. The method according to claim 11, wherein the hydraulic actuator is a hydraulic piston.

13. The method according to claim 1, wherein the tool type information is additionally determined using tool type information that comes from movement characteristics obtained during operation of the actuated arrangement.

14. The method according to claim 1, wherein the calculation is performed using a mathematical description of the arrangement and/or that a lookup table is used for performing the calculation.

15. The method according to claim 1, wherein the actuated arrangement comprises the tool that is attached to the tool attachment device, the tool taken from the group comprising forks, bale grapplers, shovels and buckets, where the tools are used interchangeably.

16. The method according to claim 15, wherein the tool is taken from the group comprising forks, bale grapplers, shovels, and/or buckets.

17. The method according to claim 1, wherein pressure sensor information is compensated for friction, speed and fluid flow effects, influencing the pressure sensor information obtained by a pressure sensor.

18. The method according to claim 1, wherein the at least one position sensor is at least one translational position sensor and/or at least one angular position sensor.

19. An electronic controller device for operating an actuated arrangement, the actuated arrangement including:

a lifting boom, a lifting actuator, a tool attachment device, and a tilting actuator, wherein the electronic controller device is configured to calculate torque using an attitude of the tool attachment device, a mass connected to the tool attachment device and tool type information corresponding to a tool selected from a plurality of tools attached to the tool attachment device, wherein the electronic controller device is configured to determine the tool type information using an automated tool type identification device and/or using tool type information that is entered by an operator, wherein the electronic controller device is configured to determine the attitude of the tool attachment device using a positional information of the lifting boom and/or of the tool attachment device using information of at least one position sensor, wherein the electronic controller device is configured to generate a modified control signal to be applied to a control valve arrangement to control the actuated arrangement, the modified control signal being a control signal modified based on the calculated torque, and wherein the modified control signal causes a first tool of the plurality of tools to, when attached to the tool attachment device, move at an operating speed for a certain operating command position set by the operator and the modified control signal causes a second tool of the plurality of tools to, when attached to the tool attachment device, move at the operating speed at the certain operating command position.

20. An actuated arrangement comprising:

a lifting boom, an associated lifting actuator, a tool attachment device for attachment of a tool, an associated tilting actuator, and a controller device, wherein the controller device is configured to calculate torque using an attitude of the tool attachment device, a mass connected to the tool attachment device and tool type information corresponding to a tool selected from a plurality of tools attached to the tool attachment device, wherein the controller device is configured to determine the tool type information using an automated tool type identification device and/or using tool type information that is entered by an operator, wherein the controller device is configured to determine the attitude of the tool attachment device using a positional information of the lifting boom and/or of the tool attachment device using information of at least one position sensor, wherein the controller device is configured to generate a modified control signal to be applied to a control valve arrangement to control the actuated arrangement, the modified control signal being a control signal modified based on the calculated torque, and wherein the modified control signal causes a first tool of the plurality of tools to, when attached to the tool attachment device, move at an operating speed for a certain operating command position set by the operator and the modified control signal causes a second tool of the plurality of tools to, when attached to the tool attachment device, move at the operating speed at the certain operating command position.

21. A working vehicle, comprising the actuated arrangement according to claim 20.

* * * * *